US006945206B1

(12) United States Patent
Mobley

(10) Patent No.: US 6,945,206 B1
(45) Date of Patent: Sep. 20, 2005

(54) LOBE-LESS CAM FOR USE IN A SPRINGLESS POPPET VALVE SYSTEM

(76) Inventor: George Wayne Mobley, 2759 Deford Mill Rd., Hampton Cove, AL (US) 35763

( * ) Notice: Subject to any disclaimer, the term of this patent is extended or adjusted under 35 U.S.C. 154(b) by 0 days.

(21) Appl. No.: 10/821,331

(22) Filed: Apr. 9, 2004

(51) Int. Cl.[7] ..... F01L 1/30
(52) U.S. Cl. ..... 123/90.24; 123/90.6; 123/90.26; 123/90.25; 123/90.31; 123/90.17
(58) Field of Search ..... 123/90.24, 90.26, 123/90.6, 90.15–90.17, 90.27, 90.31, 90.39, 123/90.44; 251/251

(56) References Cited

U.S. PATENT DOCUMENTS 1,280,912 A * 10/1918 Waterman ..... 74/567
5,058,540 A * 10/1991 Matsumoto ..... 123/90.17
6,619,250 B2 * 9/2003 Folino ..... 123/90.16
6,705,262 B2 * 3/2004 Battlogg ..... 123/90.26
6,796,277 B2 * 9/2004 Battlogg ..... 123/90.26

FOREIGN PATENT DOCUMENTS

FR 2616510 A1 * 12/1988 ..... F01L 1/30

* cited by examiner

*Primary Examiner*—Thomas Denion
*Assistant Examiner*—Kyle M. Riddle
(74) *Attorney, Agent, or Firm*—Ruden McClosky; Staney A. Kim, Esq.

(57) ABSTRACT

A lobe-less cam for use in a springless poppet valve system is disclosed including a cam shaft having at least one surrounding region, at least one asymmetrical cam groove formed in the at least one surrounding region, and wherein the at least one asymmetrical cam groove has a lift portion and a descent portion.

3 Claims, 3 Drawing Sheets

LOBE-LESS CAM FOR USE IN A SPRINGLESS POPPET VALVE SYSTEM

TECHNICAL FIELD

The present invention relates generally to the actuation of valves in an internal combustion engine utilizing poppet valves. More specifically, the present invention relates to a lobe-less cam for the mechanical opening and closing of the valves by a camshaft/follower combination without springs.

BACKGROUND OF THE INVENTION

Conventional poppet valve systems used in four-stroke internal combustion engines are typically biased to a closed position using a spring. The valve is moved to an open position against the force of the spring by a cam or cam-actuated rocker arm. On the open stroke of the valve, the cam or rocker arm also must move the valve counter to the momentum of the valve such that the open force required is effectively doubled. These conventional poppet valve systems, however, are limited with regard to speed at which the valves can be actuated. As will be appreciated, the limit on the valve actuation speed, in turn, limits the rate at which the engine can turn (i.e., engine rpm). As engine torque and speed dictate engine power, limits on the engine rpm constrain the power of an engine.

In particular, increasing the actuation speed of the valve necessarily increases the force and stress applied to the components of the valve train. To compensate for the increased force and stress, the valve train components must be made stronger. Strengthening the valve train components is most often achieved by increasing the mass of the components. This increased mass, however, requires the use of a stiffer valve spring that, in turn, further increases the force and stress on the valve train components. Moreover, increasing the mass of the valve train components increases the overall reciprocating weight of the engine and, therefore, has a detrimental effect on engine performance. Thus, a balance between the stiffness of the valve spring and the mass of the valve train components limits the peak valve actuation speed of a valve train.

Removing the spring from the valve train alleviates the issues regarding the force need to open the valve, however, such springless valve systems are expensive to manufacture and maintain. Specifically, current springless valve systems must be manufactured and assembled to very tight tolerances in order to prevent lash or binding in the system. Additionally, during operation, because of the tight tolerances that are required, springless poppet valve systems frequently have to be adjusted resulting in increased maintenance requirements.

Thus, there is a need for a springless poppet valve system that overcomes the problems associated with existing poppet valve systems.

SUMMARY OF THE INVENTION

The present invention eliminates the above-mentioned needs by providing a lobe-less cam for use in a springless poppet valve system.

In accordance with the present invention, there is provided a lobe-less cam for use in a springless poppet valve system. The lobe-less cam includes a cam shaft having at least one surrounding region, at least one asymmetrical cam groove formed in the at least one surrounding region, and wherein the at least one asymmetrical cam groove has a lift portion and a descent portion.

The present invention is further directed to a springless poppet valve system including a poppet valve movable between an open position and a closed position, and a lobe-less cam having at least one asymmetrical cam groove, wherein the at least one asymmetrical cam groove accommodates a cam follower disposed to engage the lobe-less cam in the at least one asymmetrical cam groove and being operatively engaged to the poppet valve so as to move the valve from the closed position to the open position when a lift portion of the at least one asymmetrical cam groove engages the cam follower.

The present invention is additionally directed to a springless poppet valve system including a poppet valve movable between an open position and a closed position, a lobe-less cam having at least one asymmetrical cam groove, wherein the at least one asymmetrical cam groove accommodates a cam follower disposed to engage the lobe-less cam in the at least one asymmetrical cam groove and being operatively engaged to a rocker arm assembly, and wherein the poppet valve moves from the closed position to the open position when a lift portion of the at least one asymmetrical cam groove engages the cam follower, the cam follower operatively engaging the rocker arm assembly.

DETAILED DESCRIPTION OF THE INVENTION

Figure 1:
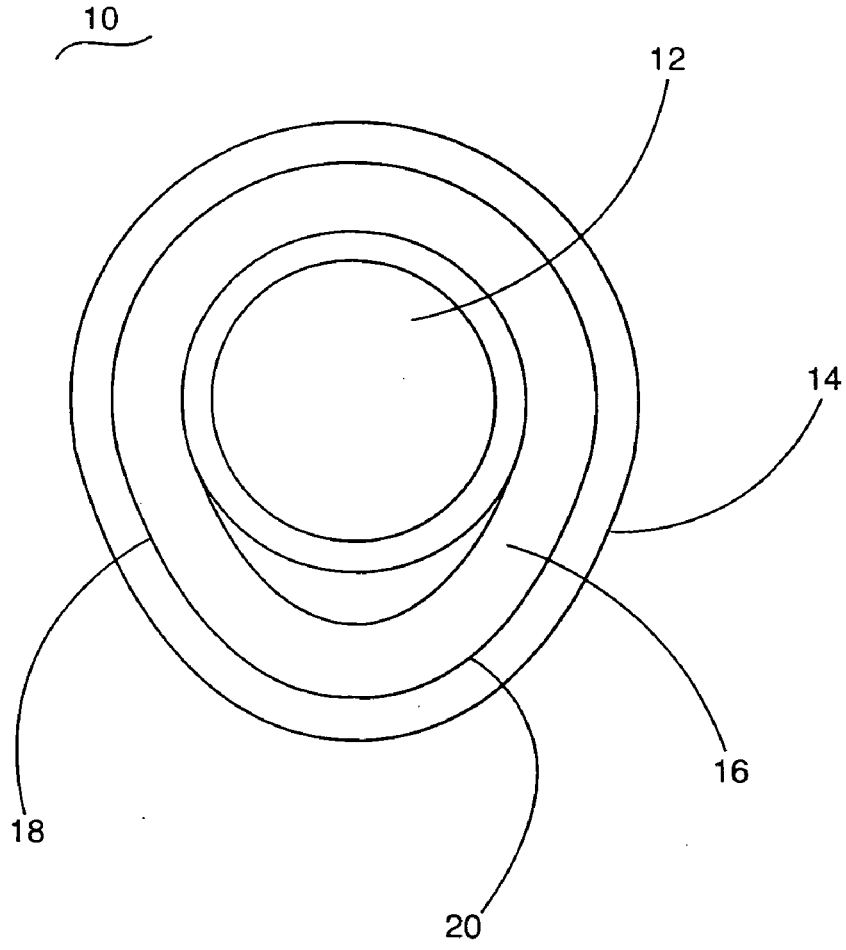
FIG. 1 is a front view of the preferred embodiment of the present invention.

Referring now to FIG. 1, the preferred embodiment of the present invention is illustrated as lobe-less cam 10. Lobe-less cam 10 includes a cam shaft 12 having at least one surrounding region 14. Cam shaft 12 and at least one surrounding region 14 can be formed as single unitary piece.

At least one surrounding region 14 incorporates at least one asymmetrical cam groove 16 formed in at least one surrounding region 14. At least one asymmetrical cam groove 16 has a lift portion 18 and a descent portion 20. At least one asymmetrical cam groove 16 functions to accommodate a pin of a cam follower (illustrated in FIGS. 2–4), with lift portion 18 and descent portion 20 serving to actuate the rising and falling movements of the cam follower, as discussed below. As a result of the use of lift portion 18 and descent portion 20, asymmetrical cam groove 14 is ellipsoid in shape. Corresponding surrounding region 14 can be ellipsoid in shape as well, however such a shape for surrounding region 14 is not required.

Figure 3:
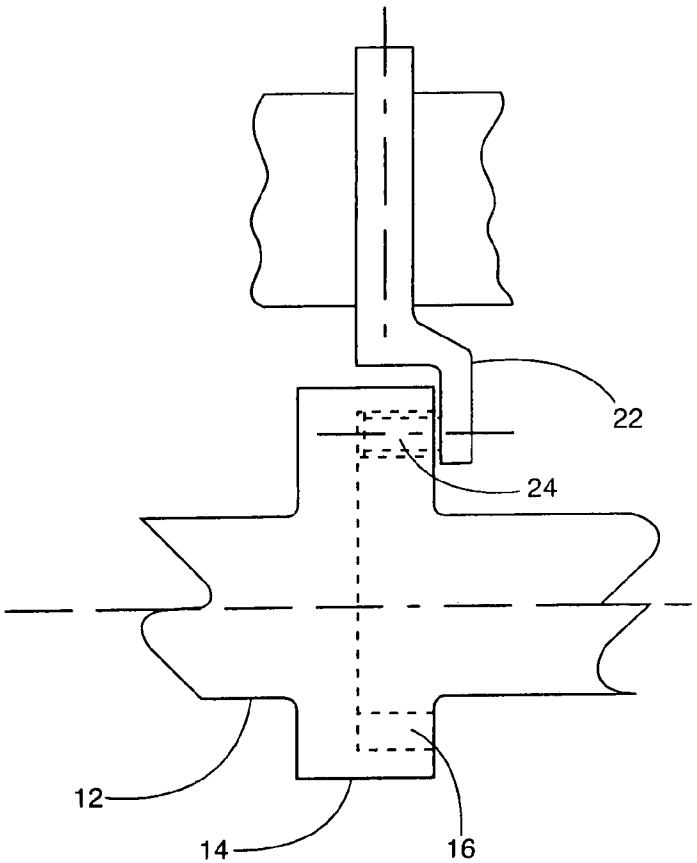
FIG. 3 is a side view of the present invention illustrated in FIG. 2.
Figure 2:
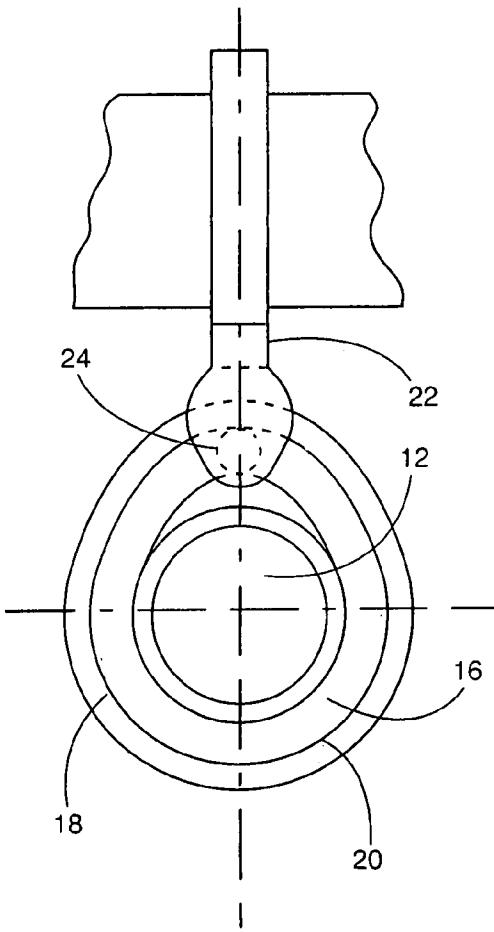
FIG. 2 is a front view of the present invention shown in FIG. 1 including a cam follower.

Referring now to FIGS. 2 and 3, lobe-less cam 10 is illustrated in operative engagement with a cam follower 22. Cam follower 22 incorporates a pin 24 in order to operatively engage asymmetrical cam groove 16. Pin 24 is positioned in asymmetrical cam groove 16, thus, as cam shaft 12 rotates about its longitudinal axis, thereby rotating asymmetrical cam groove 16, pin 24 follows along inside asymmetrical cam groove 16.

In particular, pin 24 follows rotating asymmetrical cam groove 16 into lift portion 18 and descent portion 20. In doing so, pin 24 effectuates the raising and lowering of cam follower 22. In operation, as cam shaft 12 rotates about its longitudinal axis, surrounding region 14 is similarly rotated, consequently rotating asymmetrical cam groove 16. As asymmetrical cam groove 16 is rotated, pin 24 enters into lift portion 18, causing cam follower 22 to raise in a direct relationship to the travel of pin 24 in lift portion 18. Upon reaching the terminus of lift portion 18, pin 24 enters descent portion 20, causing cam follower 22 to lower in a direct relationship to the travel of pin 24 in descent portion 20.

Figure 4:
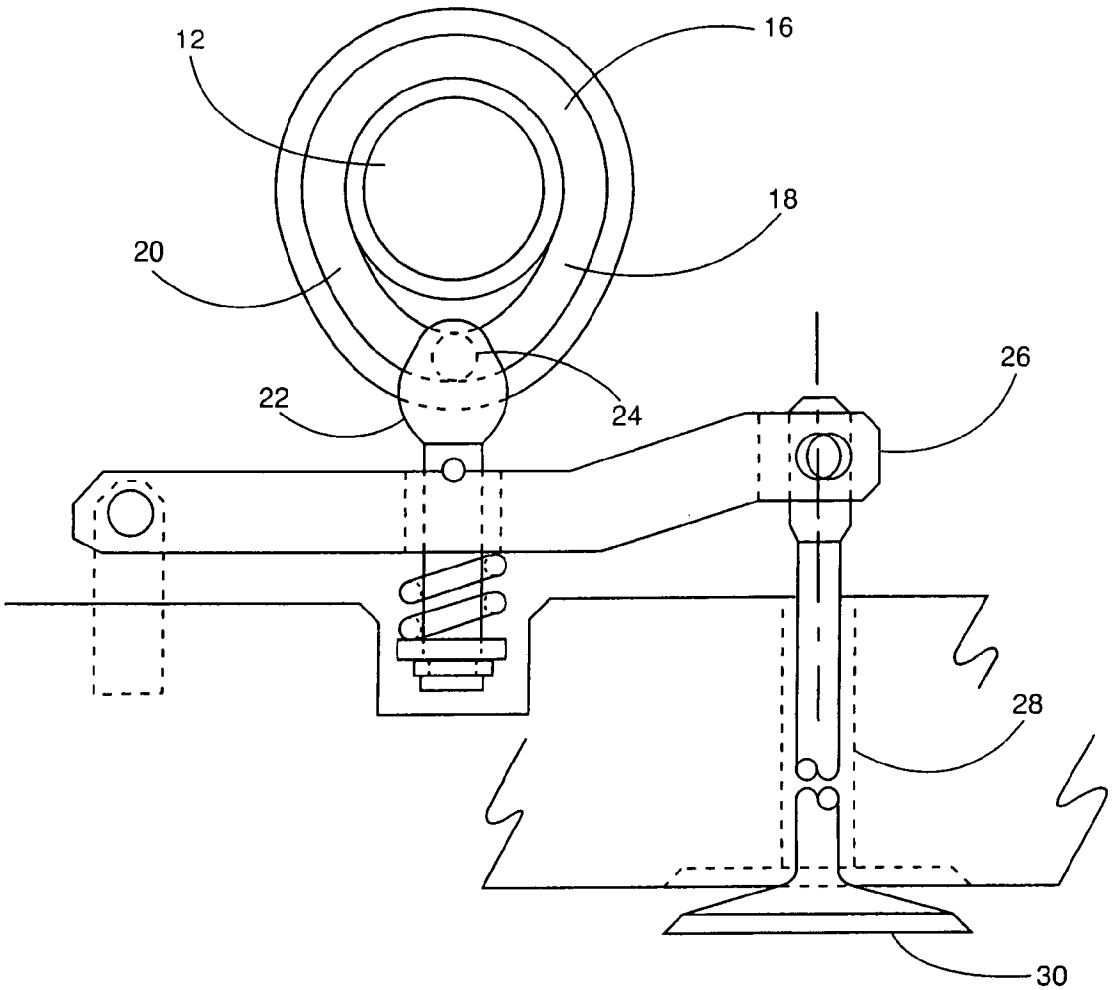
FIG. 4 is a front view of the present invention shown in FIG. 2 including a rocker arm assembly.

Referring now to FIG. 4, the preferred embodiment of the present invention is illustrated operatively engaging a rocker arm assembly 26.

In operation, as cam shaft 12 rotates about its longitudinal axis, surrounding region 14 is similarly rotated, consequently rotating asymmetrical cam groove 16. As asymmetrical cam groove 16 is rotated, pin 24 enters into lift portion 18, causing cam follower 22 to raise in a direct relationship to the travel of pin 24 in lift portion 18. As cam follower 22 is raised, rocker arm assembly 26 is raised, resulting in a raising and closing of valve 30 in valve guide 28.

Conversely, as the rotation of asymmetrical cam groove 16 is continued, pin 24 enters into descent portion 20, causing cam follower 22 to lower in a direct relationship to the travel of pin 24 in descent portion 20. As cam follower 22 is lowered, rocker arm assembly 26 is lowered, resulting in a lowering and opening of valve 30 in valve guide 28.

Although only a few exemplary embodiments of the present invention have been described in detail above, those skilled in the art will readily appreciate that numerous modifications to the exemplary embodiments are possible without materially departing from the novel teachings and advantages of this invention. Accordingly, all such modifications are intended to be included within the scope of this invention as defined in the following claims.

What is claimed is:

1. A poppet valve system for use in single or multi-valve systems said system comprising at least:

a single poppet valve movable between an open position and a closed position;

a cam comprising a cam shaft and surrounding region formed as a single unitary piece and including an asymmetrical cam groove having a lift portion and a descent portion;

a cam follower comprising a pin, the pin being positioned in the asymmetrical cam groove; and a rocker arm assembly with a pivotable fixed end portion, an opposite end portion engaging the single poppet valve, and the cam follower engaging the rocker arm between the two end portions.

2. The system of claim 1, wherein at least a portion of the cam groove is ellipsoid in shape.

3. The system of claim 1, wherein the asymmetrical groove is formed in the front face of the cam.

* * * * *